US009899156B2

(12) United States Patent
Gong

(10) Patent No.: US 9,899,156 B2
(45) Date of Patent: Feb. 20, 2018

(54) IN-LINE REED RELAY AND INTEGRATED CIRCUIT BOARD

(71) Applicant: SHENZHEN ZHIYOU BATTERY INTEGRATION TECHNOLOGY CO., LTD, Shenzhen, Guangdong (CN)

(72) Inventor: Shugang Gong, Guangdong (CN)

(73) Assignee: SHENZHEN ZHIYOU BATTERY INTEGRATION TECHNOLOGY CO., LTD, Shenzhen, Guangdong (CN)

( * ) Notice: Subject to any disclaimer, the term of this patent is extended or adjusted under 35 U.S.C. 154(b) by 0 days.

(21) Appl. No.: 15/125,133

(22) PCT Filed: Mar. 11, 2014

(86) PCT No.: PCT/CN2014/073192
§ 371 (c)(1),
(2) Date: Sep. 9, 2016

(87) PCT Pub. No.: WO2015/135128
PCT Pub. Date: Sep. 17, 2015

(65) Prior Publication Data

US 2016/0379766 A1 Dec. 29, 2016

(51) Int. Cl.
*H01H 63/02* (2006.01)
*H01H 1/58* (2006.01)
(Continued)

(52) U.S. Cl.
CPC ..... *H01H 1/5805* (2013.01); *H01H 50/10* (2013.01); *H01H 51/281* (2013.01); *H01H 2001/5888* (2013.01)

(58) Field of Classification Search
CPC ..... H01H 51/27; H01H 51/28; H01H 1/66; H01H 47/00; H01H 50/047; H01H 50/10;
(Continued)

(56) References Cited

U.S. PATENT DOCUMENTS 3,237,096 A * 2/1966 Zechman ..... H01H 36/0026 324/419
3,522,566 A * 8/1970 Van Horn ..... H01H 51/281 335/154
(Continued)

FOREIGN PATENT DOCUMENTS

CN 2395376 Y 9/2000
CN 2752947 Y 1/2008

OTHER PUBLICATIONS

International Search Report in corresponding PCT Application No. PCT/CN2014/073192, dated Dec. 2, 2014.

*Primary Examiner* — Shawki S Ismail
*Assistant Examiner* — Lisa Homza
(74) *Attorney, Agent, or Firm* — Leason Ellis LLP

(57) ABSTRACT

An inline reed relay comprises at least one reed assembly, at least one pair of metal pins, a housing and a control pin disposed on the housing. The reed assembly comprises at least two reed switches, each having two pins. The metal pins are respectively connected to the two pins of the reed switches. One end of each metal pin extends out of the housing. The inline reed relay allows the reed switches to be integrated through the injection molded housing, and the reed switches are connected to an external circuit board via the metal pins, because the metal pins can be maintained a fixed shape and difficult to deform. The processing size and position tolerances of the inline reed relay can meet the requirements of mechanized automatic welding, thereby improving welding efficiency and production assembly efficiency and reducing labor costs.

2 Claims, 4 Drawing Sheets

(51) Int. Cl.
*H01H 50/10* (2006.01)
*H01H 51/28* (2006.01)

(58) Field of Classification Search
CPC .... H01H 50/041; H05K 1/184; H05K 5/0017; H05K 5/0217; H02H 3/08
USPC ..... 335/133
See application file for complete search history.

(56) References Cited

U.S. PATENT DOCUMENTS 3,562,597 A * 2/1971 White ..... H01H 51/284 335/153
3,845,431 A * 10/1974 Bongard ..... H01H 51/28 335/152
3,993,970 A * 11/1976 Brownell ..... H01H 51/281 333/262
4,019,164 A * 4/1977 Deeg ..... H01H 67/24 200/175
4,084,142 A * 4/1978 Campbell ..... H01H 51/281 335/152
4,286,241 A * 8/1981 Olivenbaum ..... H01H 51/281 335/151
4,412,267 A * 10/1983 Hansen ..... H02H 3/10 335/152
4,870,385 A * 9/1989 Jewell ..... H01H 51/28 335/4
5,258,731 A * 11/1993 Zemke ..... H01H 50/10 335/151
5,684,441 A * 11/1997 Graeber ..... H01H 51/28 335/151
6,271,740 B1 * 8/2001 Chikamatsu ..... H01H 51/28 335/151
6,429,758 B1 * 8/2002 Emelo ..... H01H 51/281 335/152
7,317,368 B2 1/2008 Shimizu et al.

* cited by examiner

IN-LINE REED RELAY AND INTEGRATED CIRCUIT BOARD

CROSS-REFERENCE TO RELATED PATENT APPLICATIONS

This application is a U.S. National Phase Application under 35 U.S.C. § 371 of International Patent Application No. PCT/CN2014/073192, filed Mar. 11, 2014, which is incorporated herein by reference in its entirety. The International Application was published in Chinese on Sep. 17, 2015 as International Publication No. WO 2015/135128 A1.

TECHNICAL FIELD

The present invention relates to the field of electronic component, particularly, to an in-line reed relay and integrated circuit board.

BACKGROUND

The electronic appliances are developing in the direction of miniaturization and micromation, and the requirements of integration level for integrated circuit board are increasing. The size of the space occupied by the electronic components will directly affect the size and integration level of the integrated circuit board. In the application, existing reed switch is usually welded on the integrated circuit board as a single electronic component, because the pins of the reed switch need to be bent before being welded on the integrated circuit board, however the pins of the reed switch are fine, and is not easy to shape, it is difficult to guarantee position tolerance after bending, and it is currently difficult to apply the reed switches to automatic welding machinery, the reed switches are welded manually. However, for the integrated circuit board of high integration level, the reed switches are applied widely and generally, a single integrated circuit board is likely to use more than one reed switches, using manual welding operations can guarantee stability and precision welding, but the production efficiency is low, and this procedure takes a lot of labor and working hours, which is time-consuming, costly, and difficult to meet the market requirements.

SUMMARY

The object of the present invention is to provide an inline reed relay, to solve the problem that the pins of the reed switch need to be bent during welding, and the position tolerance of the bent pins is difficult to guarantee, resulting in spending a lot of labor and working hours, which is time-consuming, costly, and difficult to meet the market requirements.

The technical solution of the present invention is: an inline reed relay, wherein the inline reed relay comprises at least one reed assembly and a housing configured to receiving the at least one reed assembly, the reed assembly comprises at least two reed switches, each reed switch has two pins, the inline reed relay also comprises at least one pair of metal pins respectively connected to the two pins of the reed switch, an end portion of each metal pin is fixedly connected with respect to the housing and a tip of the end portion extends out of the housing, the inline reed relay also comprises a control pin disposed on the housing and electrically connected with the reed assembly to connect to a power supply for controlling each of the reed switches to open or close.

Specifically, the reed assembly comprises two reed switches arranged in parallel, a coil layer winding the two reed switches and configured to control the two reed switches to open or close, a shield layer winding the coil layer and electrically connected to the pins of the reed switches; one of the at least one pair of metal pins is electrically connected to one pin of the reed switch, the other of the at least one pair of metal pins is electrically connected to the other pin of the reed switch, the control pin and the coil layer is electrically connected.

Specifically, the inline reed relay further comprises a support configured to support the reed assembly and integrate the reed assemblies together, wherein the support is positioned on the exterior of the housing.

More specifically, the number of the reed assembly is four, the four reed assemblies are arranged in a matrix with each two reed assemblies in a line.

Specifically, the support is a strip, the strip is provided with U-shaped grooves matched with sides of reed assembly and configured to receive the reed assemblies; the number of the U-shaped grooves is four, the four U-shaped grooves are used to receive the four reed assemblies, a central axis of each of the reed assemblies is parallel to the central axis of the strip.

More specifically, the four U-shaped grooves are divided into two pairs disposed on opposite sides of the strip.

Specifically, the housing comprises a upper cover configured to cover and connect with one side of the support, a lower cover configured to cover and connect with the other side of the support, a left cover configured to cover one end of the support and connect with one end of the upper cover and one end of the lower cover, a right cover configured to cover the other end of the support and connect with the other end of the upper cover and the other end of the lower cover.

More specifically, the number of the reed assembly is two, the two reed assemblies are arranged side by side.

Specifically, the housing comprises a front cover configured to cover one side of the two reed assemblies, a rear cover configured to cover the other side of the two reed assemblies and connect with the front cover, a left cover configured to cover one end of the two reed assemblies and connect with one end of the front cover and one end of the rear cover, and a right cover configured to cover the other end of the two reed assemblies and connect with the other end of the front cover and the other end of the rear cover.

An integrated circuit board, the integrated circuit board is provided with and electrically connected with the inline reed relay mentioned above.

The inline reed relay of the present invention allows the reed switches being integrated through the injection molded housing, and the reed switches are connected to an external circuit board via the metal pins, without the pins of the reed switches being connected to the external circuit board directly. Because the metal pins can be maintained a fixed shape and difficult to deform and the housing is formed through injection molding, the processing size and position tolerances of the inline reed relay can meet the requirements of mechanized automatic welding, such that large-scale application of the inline reed relay in mechanized automatic welding is allowed, and more than one reed switches may be integrated in the circuit at one time, which can improve welding efficiency and production assembly efficiency, saves both time and labor, reduce the labor costs, and meet the requirements of the market.

The present invention also provides an integrated circuit board, the integrated circuit board is provided with and electrically connected with the inline reed relay mentioned above. The position tolerance of the metal pins can be guaranteed, and therefore the inline reed relay can be applied to mechanical automatic welding, thereby greatly improving production efficiency.

DETAILED DESCRIPTION OF THE EMBODIMENT

To make the objectives, technical solutions, and advantages of the present invention clearer and more comprehensible, the following further describes the present invention in detail referring to the accompanying drawings and embodiments. It should be understood that the specific embodiment described herein is merely used to explain the present invention but is not used to limit the present invention.

Figure 1:
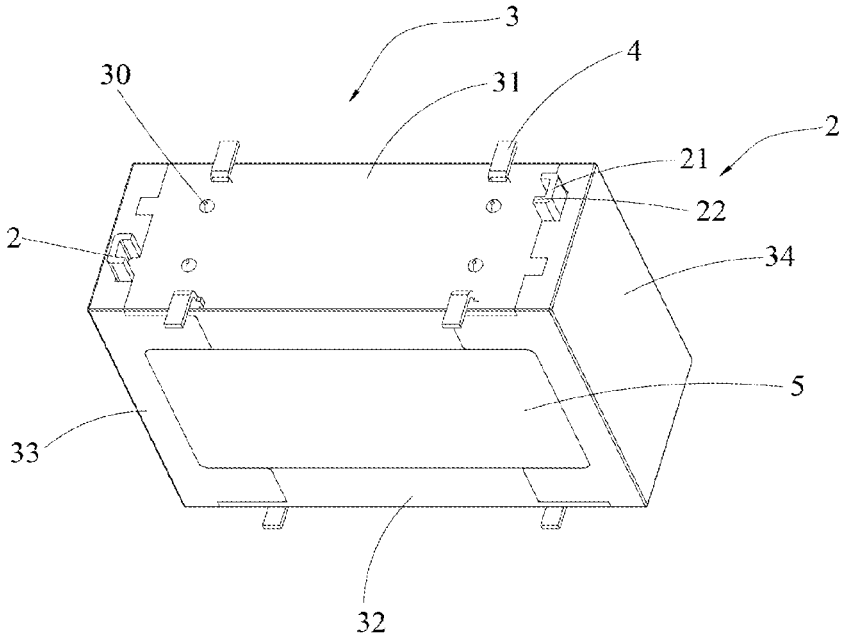
FIG. 1 is a perspective view of the inline reed relay according to an embodiment of the present invention.
Figure 2:
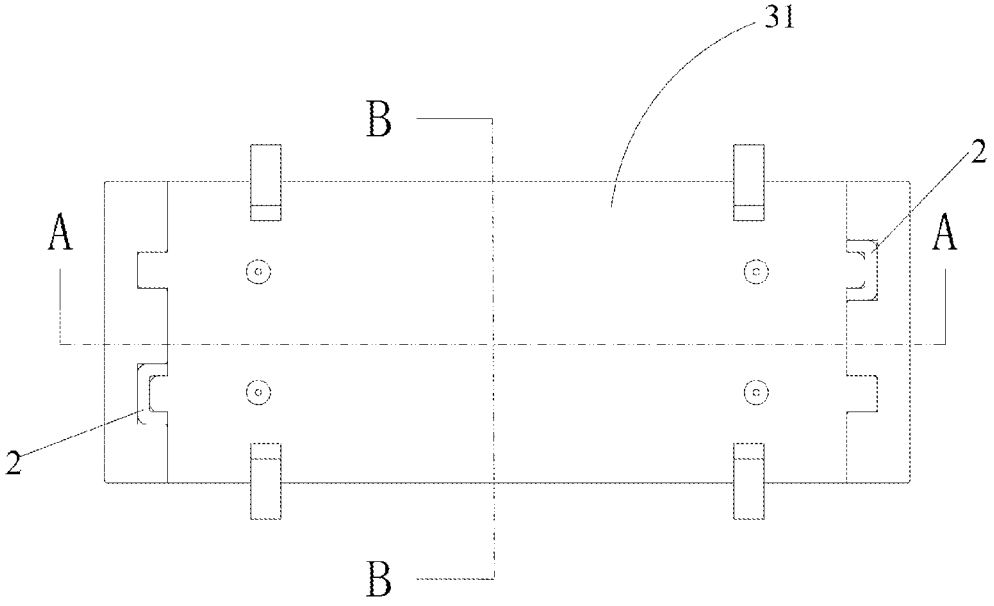
FIG. 2 is a front view of the inline reed relay in FIG. 1.
Figure 3:
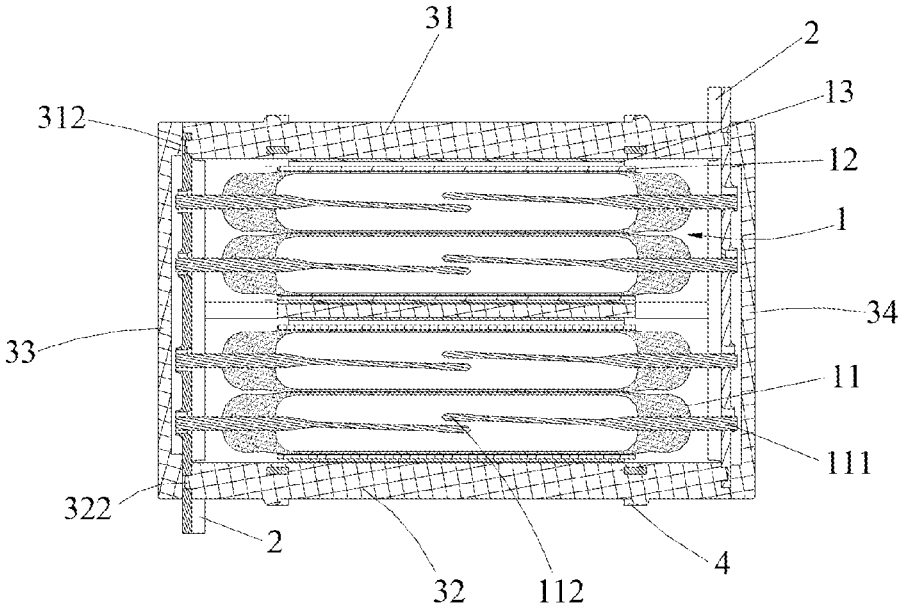
FIG. 3 a sectional view along the A-A direction in of FIG. 2.
Figure 4:
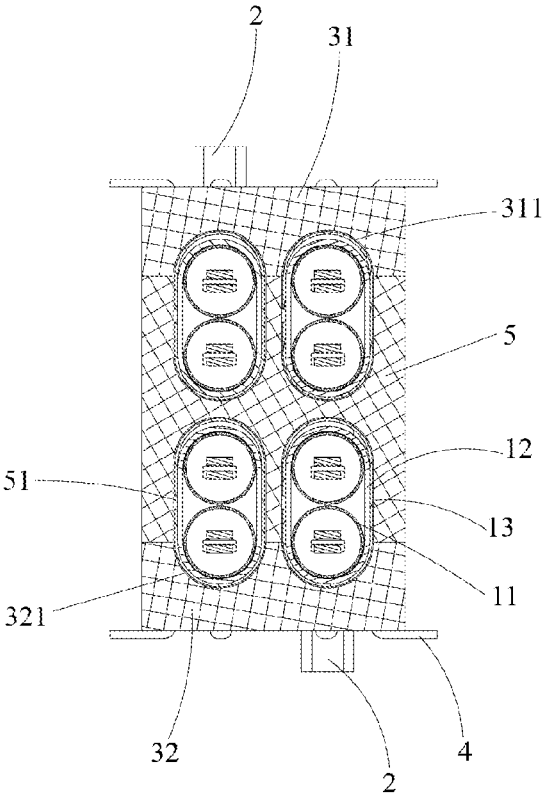
FIG. 4 is a sectional view along the B-B direction of FIG. 2.

As shown in FIGS. 1-4, embodiments of the inline reed relay of the present invention are provided. The inline reed relay comprises at least one reed assembly 1 and a housing 3 configured to receiving the at least one reed assembly 1. Each reed assembly comprises at least two reed switches 11, each reed switch 11 has two pins 111, the inline reed relay also comprises at least one pair of metal pins 2 respectively connected to the two pins 111 of the reed switch 11, an end portion of each metal pin 2 is fixedly connected with respect to the housing 3 and a tip of the end portion extends out of the housing 3. The housing 3 may be made of insulated, thermal plastic through injection molding processing. The end portion of the metal pin 2 extends out of the housing to connect with an external circuit board. Specifically, each metal pin 2 can be connected with the external circuit board through welding. Each metal pin may be made of a material having a low resistivity such as copper, aluminum or the like, in order to ensure good electrical conductivity and a fixed shape. The inline reed relay also comprises a control pin 4 disposed on the housing 3 and electrically connected with the reed assemblies 1 to connect to a power supply for controlling each of the reed assemblies to open or close, such that the in-line reed relay is controlled to open or close through the current introduced by the control pin 4, thereby controlling the circuit where the in-line reed relay is arranged to open or close. The present invention provides a reed relay, at least two reed switches are integrated together to form the inline reed relay, because the inline reed relay is connected to the external circuit board through a pair of metal pins, without the pins 111 of the reed switch 11 being connected with the external circuit board directly, and each metal pin 2 can maintain a fixed shape and difficult to deform, so the processing size and position tolerance can meet the requirements of mechanized automatic welding. Bedsides the housing 3 is made plastic through injection molding, which can ensure that the relay having fixed shape and high position tolerances and dimensional may be manufactured, such that large-scale application of the inline reed relay in mechanized automatic welding is allowed, that is, more than one reed switches 11 may be welded at one time, which can improve welding efficiency and production assembly efficiency, saves both time and labor, reduce the labor costs, and meet the requirements of the market compared with the existing working manner that single reed switch is welded manually at one time.

Specifically, the reed assembly 1 comprises two reed switches 11 arranged in parallel, a coil layer 12 winding the two reed switches 11 and configured to control the two reed switches 11 to open or close, a shield layer 13 winding the coil layer 12 and electrically connected to the pins 111 of the reed switches 11. The coil layer 12 controls the reed 112 of the reed switch 11 to close or open through the magnetic field changes generated by the current through the coil layer, thereby controlling the circuit where the inline reed relay is arranged to close or open. The shield layer 13 is configured to shield external magnetic or electric field affecting on the reed switch 11, to prevent the reed switch 11 from opening and closing accidentally when affected by external magnetic fields. One of the at least one pair of metal pins 2 is electrically connected to one pin 111 of the reed switch 11 to serve as a media electrode (assuming it is anode) electrically connected to the external circuit board. The other of the at least one pair of metal pins 2 is electrically connected to the other pin 111 of the reed switch 11 to serve as the cathode connected to the external circuit board, such that the reed switches 11 are electrically connected to the circuit board through the metal pins 2, to control the circuit on the circuit board to open or closes. Because the two reed switches 11 are arranged side by side, the two reed switches can shared the metal pin 2, one metal pin 2 may connect two reed switches 11 to the circuit, which can not only improve the welding efficiency, but also reduce the volume of space occupied by the reed switches 11. The control pin 4 and the coil layer 12 are electrically connected, the control pin 4 introduces external current to supply electric power to the coil layer 12, so that the electromagnetic field generated by the coil layer 12 controls the reed of the reed switch 11 to open and close. Specifically, the coil layer 12 may be manufactured by winding the enameled wire, the control pin 4 may be welded to the coil layer 12 through a paint removing welding technology, and the shield layer 13 may be manufactured by winding a metal foil.

Further more, the inline reed relay further comprises a support 5 configured to support each reed assembly and integrate the reed assemblies together, wherein the support 5 is positioned in the exterior of the housing 3 and enclosed by the housing.

Specifically, as one embodiment, the inline reed relay may comprises four reed assemblies, the four reed assemblies are arranged in a matrix with each two reed assemblies in a line. Then the inline reed relay can comprises eight reed switches 11, that is, eight reed switches 11 may be welded at one time, which can greatly improve production efficiency and reduce labor costs.

Specifically, the support 5 is a strip, the strip is provided with U-shaped grooves 51 matched with sides of reed assembly 1 and configured to receive the reed assemblies; the number of the U-shaped grooves 51 is four, the four U-shaped grooves are used to receive the four reed assemblies 1, a central axis of each of the reed assemblies is parallel to the central axis of the strip. That is, the respective reed assembly and the respective strip are arrange side by side, such arrangement may reduce the volume of space occupied by the assembled supports 5 and the reed switches 11.

More specifically, the four U-shaped grooves 51 are divided into two pairs disposed on opposite sides of the strip, such that a pair of reed assemblies 1 arranged side by side can share one metal pin 2 and four reed switches 11 may connected to the circuit through one metal pin 2.

Further more, to position and fix the metal pin 2 more firmly, the metal pin 2 may be shaped as a strip with a cross section of "凹", the strip comprises a base 21 and two side walls 22 extending from the opposite edges of the base 21. The base 21 and the side walls 22 are enclosed to form a recess. The base 21 is provided with through holes (not shown) to be inserted by the pins 111 of the reed switches 11. Compared with flat pin, the structure of the pin with a cross section of "凹" has better structural stability, and thus the pin is not easy to deform, such that it can ensure that the metal pin 2 is firmly positioned and fixed, therefore the position tolerance of the metal pin of the inline reed relay may be assured, to provide a particular structure that can be implemented for the mechanized automatic welding.

Specifically, the housing 3 comprises a upper cover 31 configured to cover and connect with one side of the support 5, a lower cover 32 configured to cover and connect with the other side of the support 5, a left cover 33 configured to cover one end of the support 5 and connect with one end of the upper cover 31 and one end of the lower cover 32, a right cover 34 configured to cover the other end of the support 5 and connect with the other end of the upper cover 31 and the other end of the lower cover 32. Accordingly, the upper cover 31 and the lower cover 32 are respectively provided with grooves 311, 321 matched with the side walls of the reed assemblies, such that the reed assemblies 1 may be arranged between the upper cover 31 and the support 5 and between the lower cover 32 and the support 5 cover, the left cover 33 partially covers the metal pins 2 and is connected with the upper cover 31 and the lower cover 32, uncovered ends of the metal pins 2 extend from the connection positions between the left cover 33 and the upper cover 31 or the lower cover 32 and between the right cover 34 and the upper cover 31 or the lower cover 32 to weld with the external circuit board. The right cover 34 has the same structure and function as the left cover 33, it doesn't need to describe in detail. Further more, to cooperate the left cover 33 and the right cover 34 with the upper cover 31 and the lower cover 32 more closely, the left cover 33 and the right cover 34 may be connected with the upper cover 31 and the lower cover 32 in a snap manner, the specific structure snap is not described here.

Further more, to position and fix the metal pins 2 more firmly, the upper cover 31, lower cover 32 are respectively provided with positioning protrusions 312, 322 matched with the recesses with a cross section of "凹" of the metal pins 2, thereby ensuring that the metal pins 2 may be securely positioned when the inline reed relay is assembled, such that the geometric dimensions of the manufactured inline reed relay can be guaranteed.

From the above description in conjunction with the drawings, in this embodiment, four reed assemblies are provided, correspondingly, four metal pins 2 are provided. A pair of metal pins 2 respectively extend from the surfaces opposite to the upper cover 31 and the lower cover 32, that is, the inline reed relay of the present invention is dual in-line reed relay. Another beneficial effect of this structure is that: the in-line reed relay can electrically connect two different integrated circuit board together, such that in-line reed relay can not only ensure electrical communication and control the circuit to open or close, but also can serve as the connection member between two integrated circuit boards to complete cross-board connection, thereby eliminating the need of wires or other connection members.

Further, in order to position the in-line reed relay during application, to the housing 3 is also provided with positioning columns 30.

In the above embodiment, four reed assemblies of the in-line reed relay of present invention are illustrated in detail. However, the in-line reed relay of the present invention may not only comprises four reed assemblies, but may comprises two, three, five, or six assemblies, etc., depending on the specific application.

Figure 5:
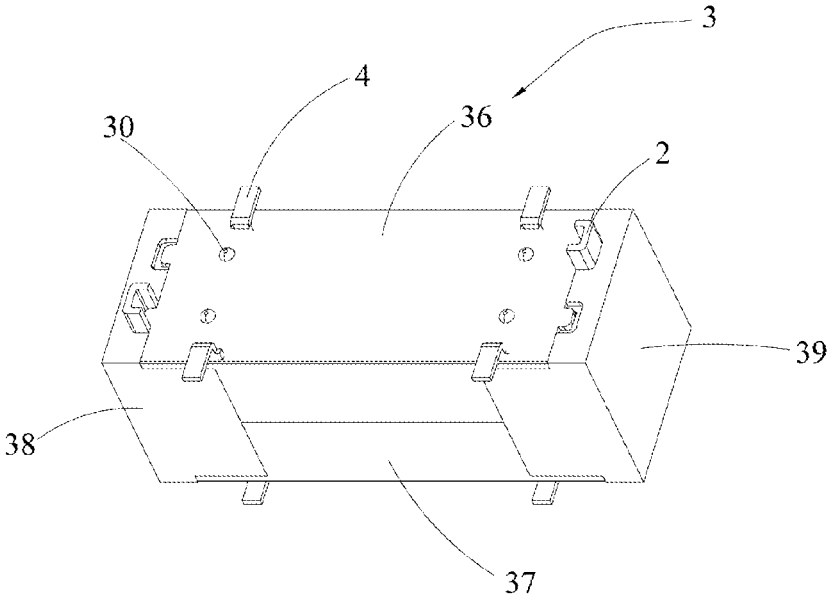
FIG. 5 is a perspective view of the inline reed relay according to another embodiment of the present invention.
Figure 6:
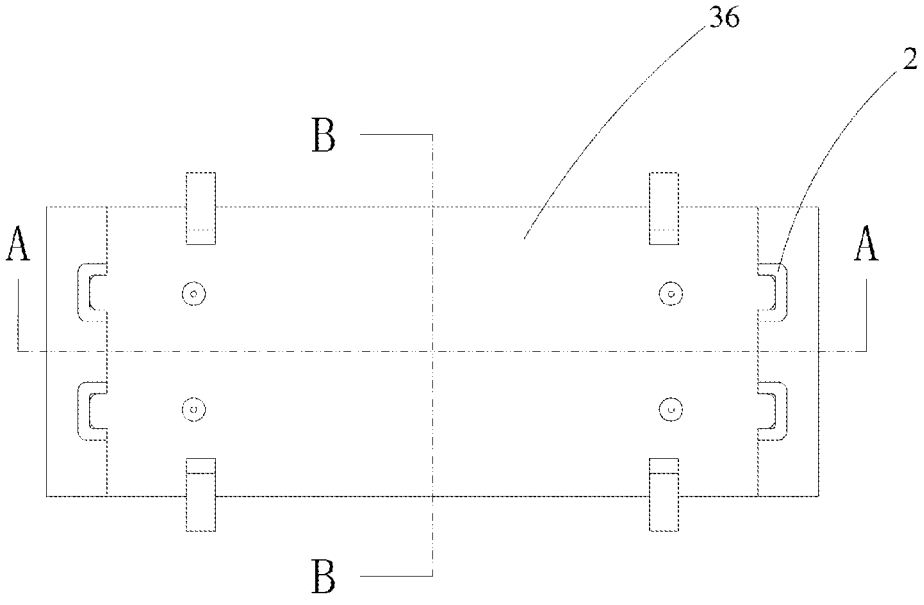
FIG. 6 is a front view of the inline reed relay in FIG. 5.
Figure 7:
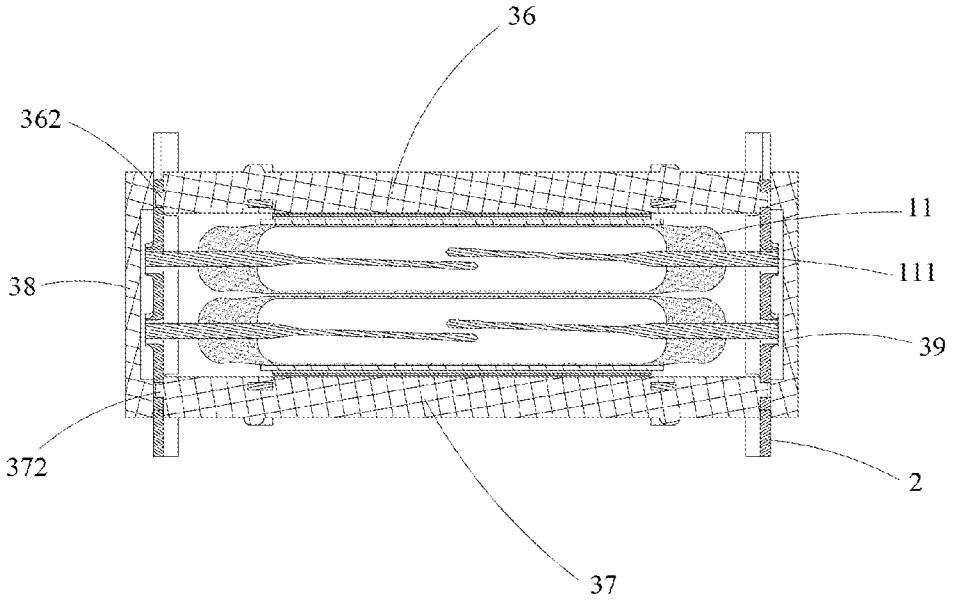
FIG. 7 a sectional view along the A-A direction in of FIG. 6.
Figure 8:
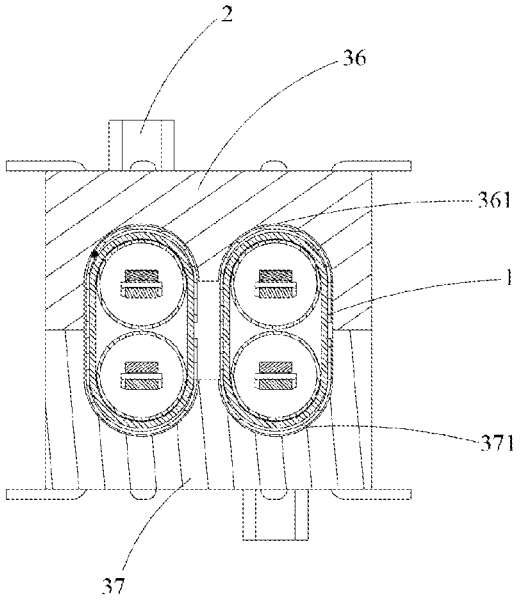
FIG. 8 is a sectional view along the B-B direction of FIG. 6.

Hereinafter, two reed assemblies are provided as an example. As shown in FIG. 5-8, two reed switch assemblies are arranged side by side, the housing 3 comprises a front cover 36 configured to cover one side of the two reed assemblies, a rear cover 37 configured to cover the other side of the two reed assemblies and connect with the front cover 36, a left cover 38 configured to cover one end of the two reed assemblies and connect with one end of the front cover 36 and one end of the rear cover 37, a right cover 39 configured to cover the other end of the two reed assemblies and connect with the other end of the front cover 36 and the other end of the rear cover 37. Of course, the front cover 36 and the rear cover 32 are respectively provided with grooves 311, 321 matched with the side walls of the reed assemblies, such that the reed assemblies 1 may be covered by the front cover 36 and the rear cover 32 when the front cover 36 and the rear cover 32 are connected together. Similarly, the front cover 36 and the rear cover 32 are respectively provided with positioning protrusions 362, 372 at the ends thereof, the positioning protrusions 362, 372 are matched with the recesses with a cross section of "凹" of the metal pins 2, such that the geometric dimensions of the manufactured inline reed relay can be guaranteed, to facilitate the mechanized automatic welding.

Similarly, in this embodiment, the housing 3 is also provided with positioning columns 30.

The present invention also provides an integrated circuit board, the inline reed relay is disposed on and connected with the integrated circuit board. Since the position machining dimensions and tolerances of the in-line reed relay meet the requirements of high accuracy, and thus the in-line reed relay may be welded together with other electronic components through mechanized automatic welding, without manual welding, which can greatly improve production efficiency and reduce labor costs, save both time and labor, thereby meeting the demands of the market.

The foregoing descriptions are merely exemplary embodiment of the present invention, but are not intended to limit the present invention. Any modification, equivalent replacement, or improvement made without departing from the spirit and principle of the present invention shall fall within the protection scope of the present invention.

What is claimed is:

1. An inline reed relay, wherein the inline reed relay comprises at least one reed assembly and a housing configured to receiving the at least one reed assembly, the reed assembly comprises at least two reed switches, each reed switch has two pins, the inline reed relay also comprises at least one pair of metal pins respectively connected to the two pins of the reed switch, an end portion of each metal pin is fixedly connected with respect to the housing and a tip of the end portion extends out of the housing, the inline reed relay also comprises a control pin disposed on the housing and electrically connected with the reed assembly to connect to a power supply for controlling each of the reed switches to open or close;

wherein the inline reed relay further comprises a support configured to support the reed assembly and integrate the reed assemblies together, wherein the support is positioned on the exterior of the housing;

wherein the number of the reed assembly is four, the four reed assemblies are arranged in a matrix with each two reed assemblies in a line; and wherein the support is a strip, the strip is provided with U-shaped grooves matched with sides of the reed assembly and configured to receive the reed assemblies, the number of the U-shaped grooves is four, the four U-shaped grooves are used to receive the four reed assemblies, a central axis of each of the reed assemblies is parallel to the central axis of the strip;

the four U-shaped grooves are divided into two pairs disposed on opposite sides of the strip;

the housing comprises an upper cover configured to cover and connect with one side of the support, a lower cover configured to cover and connect with the other side of the support, a left cover configured to cover one end of the support and connect with one end of the upper cover and one end of the lower cover, and a right cover configured to cover the other end of the support and connect with the other end of the upper cover and the other end of the lower cover.

2. An integrated circuit board, wherein the integrated circuit board is provided with and electrically connected with the inline reed relay of claim 1.

* * * * *